US006145278A

United States Patent [19]

Tanaka

[11] Patent Number: 6,145,278

[45] Date of Patent: Nov. 14, 2000

[54] TAPE PACKING METHOD

[75] Inventor: Kazuyoshi Tanaka, Sodegaura, Japan

[73] Assignee: Idemitsu Petrochemical Co., Ltd., Tokyo, Japan

[21] Appl. No.: 09/213,775

[22] Filed: Dec. 17, 1998

[30] Foreign Application Priority Data

Dec. 25, 1997 [JP] Japan ..... 9-356517
Jun. 30, 1998 [JP] Japan ..... 10-183735

[51] Int. Cl.[7] ..... B65B 63/04

[52] U.S. Cl. ..... 53/430; 53/116; 53/118

[58] Field of Search ..... 53/116, 118, 430; 19/159 R, 159 A

[56] References Cited

U.S. PATENT DOCUMENTS 2,154,344 4/1939 McGinnis .
2,181,777 11/1939 Asbelle .
2,722,729 11/1955 Wilhelm .
2,745,146 5/1956 Wilkie .
2,873,485 2/1959 Leckler .
3,081,511 3/1963 Suggs et al. .
3,281,913 11/1966 Morehead et al. .
3,478,399 11/1969 Wyatt et al. .
4,080,772 3/1978 Chambley et al. .
4,153,212 5/1979 Bauch et al. .
4,400,854 8/1983 Socha .
4,709,452 12/1987 Cooley et al. .
4,967,449 11/1990 Gasser .

*Primary Examiner*—Daniel B. Moon
*Attorney, Agent, or Firm*—Oblon, Spivak, McClelland, Maier & Neustadt, P.C.

[57] ABSTRACT

A tape packing method capable of packing a tape in such a mode that it can be let off with neither twist nor entanglement from its packing box. When the tape 1 is to be boxed and packed by dropping it, a turning force around the center portion of a packing box 4 is applied to the tape 1 being dropped into the packing box 4, and the direction of the turning force to be applied is alternately switched forward and backward at each predetermined number of turns.

6 Claims, 1 Drawing Sheet

TAPE PACKING METHOD

BACKGROUND OF THE INVENTION

1. Field of the Invention

The present invention relates to a method of packing a tape. More specifically, the invention relates to a tape packing method of loosely packing a tape being dropped into a packing box, with neither twist nor entanglement while the tape is being let off, by packing it while applying a specific turning force to it.

2. Related Art

In the packing field of the prior art, a lengthy article such as rope or wire to be used for packing articles is frequently handled in a mode taken up on a drum or bobbin in the procedure from its manufacture to its use.

This method is proper, as proposed in Examined Published Japanese Patent Application 3-34424, because the packing capacity of the wire being handled can be minimized if the wire is taken up on a core so that it may be let off for use from the inside by removing the core.

If this method is applied to a tape such as a fastener tape or zipper tape of a synthetic resin, however, the twist is accumulated while the tape is being unwound from the core, to raise a problem that the tape cannot be used, as it is, in its normal state. When this tape is to be packed, therefore, there has been adopted the so-called "loose packing", by which the tape is dropped by its own weight into and packed in a packing box. According to this method, there does not arise the problem of the accumulation of the twist in the tape being let off from the packing box. However, there arise other problems that the packing capacity increases and that the tape gets entangled in the packing box while being let off from the packing box.

In order to solve this problem, there has been proposed in Unexamined Published Japanese Utility Model Application 61-197059 an entanglement preventing device which includes a cylindrical container having an arcuate slit in its cover for piling a tape therein by dropping it in a loop shape, so that the tape can be let off upward without any entanglement from the cylindrical container through that slit.

In this case, it is possible to vertically disentangle the tapes piled in the loop shape. However, there arise difficulties that each tape let-off device has to be equipped with the cover having the arcuate slit and that the tape has to be threaded into that slit.

From these situations, there has been desired a development of a tape packing method which is freed from the twist or entanglement of the tape when this tape is to be left off from use from its packing box.

SUMMARY OF THE INVENTION

It is an object of the invention to provide a method of boxing and packing a tape while dropping it, which method can pack the tape in such a mode that it can be let off for use with neither twist nor entanglement from its packing box.

I have studied in various manners to solve the above-specified problems and have found out that the tape can be let off for use with neither twist nor entanglement by applying a predetermined turning force to the tape being dropped, to pack it in a packing box. On the basis of this founding, I have completed the invention.

Specifically, the invention has the following gists.

(1) A tape packing method for boxing and packing a tape by dropping it, wherein a turning force around the center portion of a packing box is applied to the tape being dropped into the packing box, and wherein the direction of the turning force to be applied is alternately switched forward and backward at each predetermined number of turns.

(2) A tape packing method for boxing and packing a tape by dropping it, wherein a turning force around the center portion of a packing box is applied to the tape being dropped into the packing box, wherein the direction of the turning force to be applied is alternately switched forward and backward at each predetermined number of turns, and wherein the turning radius is changed continuously or intermittently.

(3) A tape packing method for boxing and packing a tape by dropping it, wherein a turning force around the center portion of a packing box is applied to the tape being dropped into the packing box, wherein the direction of the turning force to be applied is alternately switched forward and backward at each predetermined number of turns, and wherein the position of the turning center is changed continuously or intermittently.

(4) A tape packing method for boxing and packing a tape by dropping it, wherein a turning force around the center portion of a packing box is applied to the tape being dropped into the packing box, wherein the direction of the turning force to be applied is alternately switched forward and backward at each predetermined number of turns, and wherein a specific number of turns till the switching of the turning direction is changed continuously or intermittently.

(5) A tape packing method for boxing and packing a tape by dropping it, wherein a turning force around the center portion of a packing box is applied to the tape being dropped into the packing box, and wherein the direction of the turning force to be applied is set in a predetermined direction.

(6) A tape packing method for boxing and packing a tape by dropping it, wherein a turning force around the center portion of a packing box is applied to the tape being dropped into the packing box, wherein the direction of the turning force to be applied is set in a predetermined direction, and wherein the turning radius is changed continuously or intermittently.

(7) A tape packing method for boxing and packing a tape by dropping it, wherein a turning force around the center portion of a packing box is applied to the tape being dropped into the packing box, wherein the direction of the turning force to be applied is set in a predetermined direction, and wherein the position of the turning center is changed continuously or intermittently.

(8) A tape packing method according to any of items (1) to (7), wherein the application of the turning force to the tape is carried out by a delivery pipe having a bent portion.

(9) A tape packing method for boxing and packing a tape by dropping it, wherein the tape is dropped between the center and the side wall of a packing box, wherein the packing box is turned around its center portion, and wherein the turning direction is alternately switched forward and backward at each predetermined number of turns.

(10) A tape packing method for boxing and packing a tape by dropping it, wherein the tape is dropped between the center and the side wall of a packing box, wherein the packing box is turned around its center portion, wherein the turning direction is alternately switched forward and backward at each predetermined number of turns, and wherein the tape is packed by moving the packing box in a horizontal direction.

(11) A tape packing method according to any of items (1) to (10), wherein the tape is a fastener tape or zipper tape made of a synthetic resin.

(12) A tape package wherein the tape is boxed by a method according to any of items (1) to (11).

DESCRIPTION OF THE PREFERRED EMBODIMENT

Figure 1:
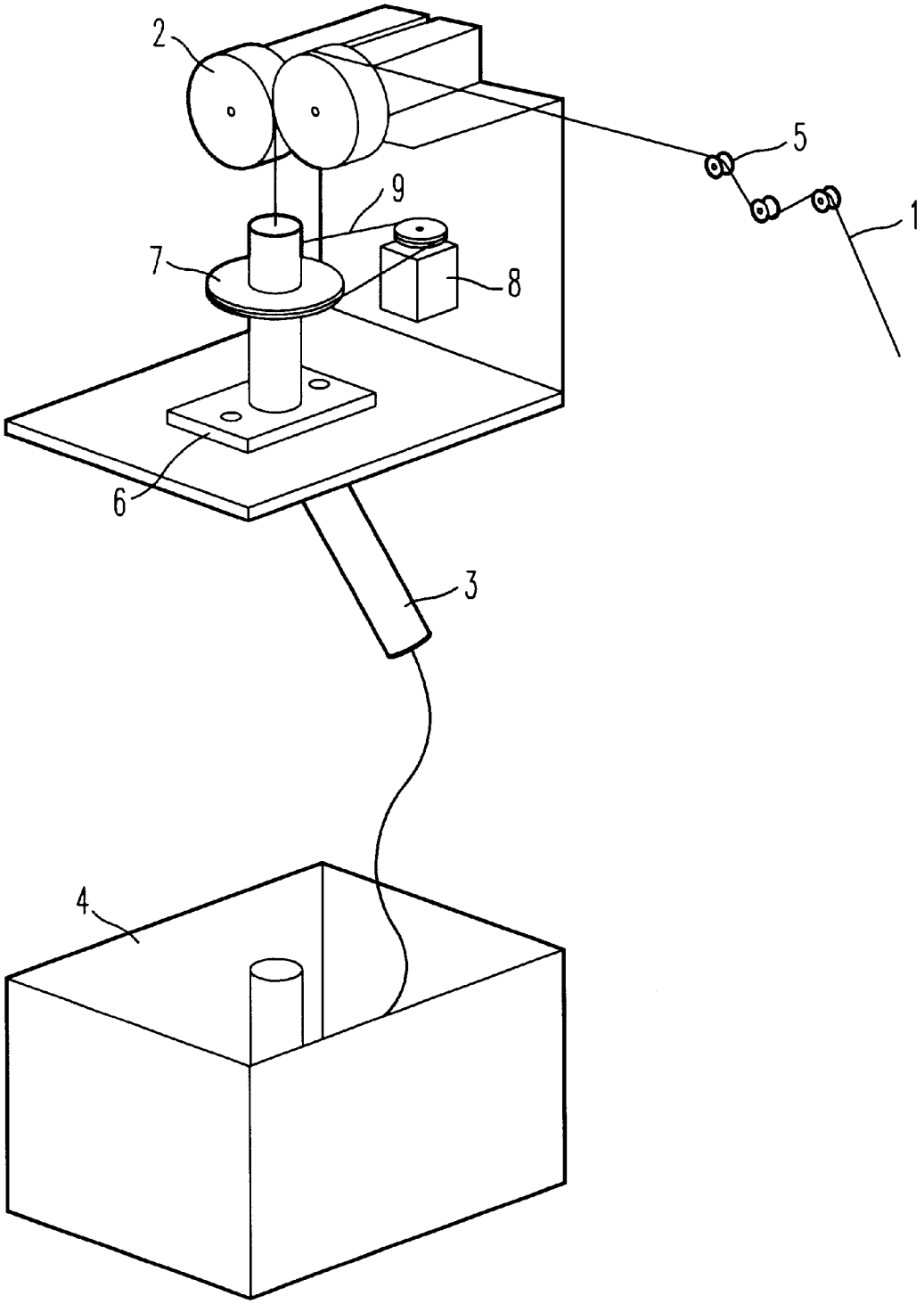
FIG. 1 is a schematic diagram showing one embodiment of a method according to the invention.

When a tape is to be subjected to the so-called "loose packing" in which it is boxed and packed while dropping, according to the invention, a turning force around the center portion of a packing box is applied to the tape dropping into the packing box, so that the tape is packed while alternating the direction of the turning force forward and backward at a predetermined number of turns.

The tape to be packed in the invention is exemplified by a fastener tape or zipper tape equipped with a fastener or a zipper of a synthetic resin or a decorating lace tape or ribbon. This tape is frequently let off, when used, from the inside of its packing box and is either thermally bonded to a backing or bonded with an adhesive or a pressure sensitive adhesive. In this case, the tape cannot be used as it is let off out of the packing box, if it is twisted or deformed by an external force at the packing time. In this case, the tape can be used only through a step of correcting the twist or deformation after it was let off out of its packing box. The invention provides a method of packing the tape which is freed from the twist or deformation when let off out of the packing box.

The method of the invention will be specifically described with reference to the accompanying drawing. The method of the invention can be practiced, for example, by employing an apparatus shown in FIG. 1. In the apparatus of this case, a tape 1 is taken up while being pinched by pinch rollers 2 and is guided through a delivery pipe having a bent portion. In this course, a turning force and a change in the turning direction are imparted to the tape 1. Next, the tape 1 having passed through the bent delivery pipe is dropped, while being turned arcuately clockwise or counter-clockwise, and is piled up between the center portion and the side wall of a packing box.

Here, guide rollers 5 are preferably used to feed the pinch rollers 2 with the tape 1. Moreover, the pinch rollers 2 are paired and rotated by a drive means in the opposite directions to each other to pinch the tape 1 inbetween and push out it downward. These pinch rollers 2 are made at their surfaces of a soft material such as rubber or a soft synthetic resin and are so adjusted of their internal pressures as not to deform the tape 1 being pinched inbetween.

On the other hand, the aforementioned delivery pipe 3 having the bent portion is suitably given an internal diameter about 1.5 to four times as large as the external diameter of the tape 1. The delivery pipe 3 is fixed just below the pinch rollers 2 by means of a bearing 6 and fixes a drive pulley 7. This drive pulley 7 is connected to an electric motor 8 through a belt 9 so that it can rotate the bent delivery pipe 3 freely.

Moreover, the bent delivery pipe 3 is provided, below its portion fixed by the bearing 6, with the bent portion which is bent at an inclination with respect to the center line of turns thereof. This inclination is so directed that the tape 1 may be delivered from the leading end of the bent portion to drop arcuately to a generally intermediate portion between the center and the side wall of the packing box 4 placed just under the delivery pipe 3. In this case, the bent portion of the delivery pipe 3 may be so shaped that its length and its angle with respect to the turning center line are selected by considering the packing speed of the tape 1, the head from the leading end of the bent portion of the delivery pipe 3 to the inner face of the packing box 4, and the internal diameter of the packing box 4. The length may be relatively enlarged, if the internal diameter of the packing box 4 is large, and the angle with respect to the turning center line of the delivery pipe 3 may be set to 10 to 30 degrees.

The method of the invention is carried out with the apparatus thus far described, by positioning the tape 1 at first by the guide rollers 5, by pinching and taking up the tape 1 between the pinch rollers 2, by threading the tape 1 from under the pinch rollers 2 into the upper open end of the delivery pipe 3, and by packing the tape 1, as delivered through the bent portion from the leading end of the delivery pipe 3, into the packing box 4 placed just under the delivery pipe 3. While tape 1 is passing the delivery pipe 3, a forward or backward turning force is applied to the delivery pipe 3 by the drive pulley 7 which is rotated by the power transmitted from the electric motor 8 through the belt 9.

The application of the turning force of the delivery pipe 3 having the bent portion to the tape 1 is desired to rotate the tape 1 forward (or clockwise) at least one turn and then backward (or counter-clockwise) at least one turn so that the tape 1 may be packed while sequentially piling up in the packing box. When the turning force can cause about 0.9 to 0.8 turns even if less than one turn, the reduction in the volumetric efficiency is as small as to establish a small space in the packing box 4. If the turning force lowers to about 0.5 turns, however, a dead space is left at a righthand (or lefthand) half of the packing box 4 thereby to invite the reduction in the volumetric efficiency. The number of turns, as required for one switching from forward to backward or vice versa is one or more, preferably about three to six.

Moreover, the tape 1 can be packed in a high packing density by changing the locus radius of the tape 1 continuously or intermittently, simultaneously with the alternate application of the forward and backward turning forces to the tape 1. In order to change the locus radius of the tape 1 or to enlarge the locus diameter, the rotating speed of the pinch rollers 2 may be increased faster than that of the drive pulley 7.

As the locus radius of the tape 1 is thus changed, the tape 1 to be sequentially piled up on the bottom face of the packing box 4 is prevented from being vertically collected at the same portion in the packing box 4, so that it is uniformly dispersed in the packing box 4 to enhance its packing density. Specifically, the tape 1 is piled up in the vicinity of the side wall of the packing box 4 while the locus radius is large, but at the center portion of the packing box 4 when the locus radius is reduced. If this change in the locus radius is repeated, therefore, the tape 1 is uniformly dispersed in the horizontal direction in the packing box 4.

When the locus radius of the tape 1 is to be changed, therefore, the uniform dispersion of the tape 1 is improved the better as the change is the more continuous and in the higher frequency. If the frequency is increased even for the intermittent change, however, it is possible to achieve a practically sufficient uniform dispersion. The frequency for changing the locus radius may be suitably selected considering the thickness, width and total length of the tape 1 and the rigidity and surface smoothness of the tape 1, and the size of the packing box 4.

Alternatively, the tape 1 may be piled up on the packing box 4 by changing the position of the turning center of the tape 1 continuously or intermittently, simultaneously with the alternate application of the forward and backward rotating forces to the tape 1. In this modification, precessions may be applied to the turning axis of the delivery pipe 3 having the bent portion when the turning force by the delivery pipe 3 is to be applied to the tape 1. Moreover, the turning center of the tape 1 is made eccentric to the center point of the packing box 4 to change the turning center freely, by making the locus radius of the tape 1 smaller than that of the usual case in which the tape 1 is arcuately packed in the packing box 4, so that the tape 1 can be uniformly dispersed in the horizontal direction in the packing box 4 thereby to improve its packing density.

Alternatively, the tape 1 may be piled up on the packing box 4 by changing a predetermined number of turns switching the turning direction of the tape 1 continuously or intermittently, simultaneously with the alternate application of the forward and backward rotating forces at each predetermined number of turns to the tape 1. If the number of turns to be applied in one direction is fixed at a predetermined value when the forward and backward turning forces are alternately applied, the turnabout of the tape 1, as packed in the packing box 4, is concentrated at one portion. Especially when the tape 1 is made of a highly rigid material, it is difficult to pack the tape 1 uniformly dispersed in the horizontal direction in the packing box 4. Therefore, the number of turns to be applied in one direction is changed so that the turnabout of the tape 1 may be prevented from being concentrated at one portion.

When the tape 1 is to be boxed and packed while being dropped, according to the invention, it can be given, while dropping into the packing box 4, the turning force around the center portion of the packing box 4 and packed in the predetermined direction of the turning force.

In this case, too, the apparatus to be used for packing the tape 1 is preferably identical with the aforementioned one. The operating conditions may be identical with the aforementioned ones excepting that the drive pulley 7 rotates the delivery pipe 3 having the bent portion in a predetermined direction.

Moreover, the tape 1 being dropped is given the turning force in the predetermined direction around the center portion of the packing box 4, and its turning radius is continuously or intermittently changed so that the tape 1 can be packed in a high packing density. This turning radius can be changed by adjusting the rotating speeds of the pinch rollers 2 and the drive pulley 7.

Moreover, the tape 1 is given the turning force in the predetermined direction, and its turning center is continuously or intermittently changed so that the tape 1 can be packed in a high packing density. In this case, the turning radius is preferably made smaller than that of the case in which the packing is performed with the turning center being fixed at the center portion of the packing box 4. Alternatively, the packing may be performed with the turning radius being made constant or changed.

Thus, the tape can be packed in the various modes. The frequency of changing the turning radius or turning center to be given to the tape is desirably lowered to suppress the accumulation of the twisting stress especially for a highly rigid tape.

Moreover, the tape 1 may be packed, as described above, by dropping it between the center and the side wall of the packing box 4 without applying no turning force to it, by turning the packing box 4 on its center portion and by switching the turning direction alternately forward and backward at each predetermined number of turns. As to the number of turns of the packing box 4, the number of turns in one direction is preferably changed at each turnabout to a always constant value, for an improvement in the uniform dispersion of the tape 1 in the packing box 4.

In this case, the delivery pipe 3 having the bent portion, and the pulley 7, the electric motor 8 and the belt 9 for driving the delivery pipe 3 can be dispensed with. Then, only a guide member such as a take guide member having a shape of a straight pipe 3 or a ring for guiding the tape 1 dropping from the pinch rollers 2 may be employed to drop the tape 1 generally vertically. Moreover, the packing box 4 is desirably turned at its pedestal by an electric motor at least one time in the forward direction and then at least one time in the backward direction.

When the pedestal of the packing box 4 is to be turned by the electric motor, moreover, the packing density of the tape 1 in the packing box 4 can be improved by turning the pedestal back and forth or circumferentially in the horizontal direction to move the turning center continuously or intermittently.

As compared with the pack of the tape obtained by the packing method of the prior art to drop the tape freely and to pack it in the packing box, the pack of the tape obtained by the method of the invention is made in such a high packing density that the tape 1 packed in the packing box 4 is orderly piled up from its leading end to its trailing end in a loop shape from the bottom face to the upper open face of the packing box 4 and that the loops of the tape 1 piled up and adjacent to each other do not get entangled by each other.

When this tape is let off for use from its pack, moreover, the let-off operation may be similar to that of the ordinary tape. Specifically, what is required is to take out the trailing end of the tape from the packing box and to let it off while being pinched by the let-off pinch rollers through the guide rolls. Since the pack of the tape of the invention is made such that the tape is packed orderly without any entanglement, as described above, the tape can be let off easily but without any entanglement.

EXAMPLE

The invention will be described more specifically on its example.

Example 1

The packing tape was exemplified by a fastener tape for a packaging bag, in which two tapes of polypropylene having a width of 12 mm, one having a ridge of a height of 1.3 mm at its center and the other having a groove to fit on the ridge at its center, were overlapped with their ridge and groove being fitted. This fastener tape had a weight of 4.6 g per meter and a total length of about 2,000 m.

The apparatus, as schematically shown in FIG. 1, was loaded with that fastener tape, and this fastener tape was taken out from the delivery pipe 3. After this, the fastener tape was packed in the packing box having an edge of 60 cm and a height of 50 cm and having a core of a diameter of 6 cm at its center portion. The turning force was applied to the fastener tape to turn it five times both forward and backward and to switch the turning direction.

As to ten packing boxes thus obtained, the trailing end of the fastener tape was subjected to the let-off test through the guide rolls by the pinch rollers. This test revealed that no fastener tape got entangled.

Separately of this, the fastener tape was packed under the same conditions as the aforementioned operating conditions, and the number of winds of the fastener tape in one direction was examined by counting the total of the (forward and backward) turns while letting off the fastener tape from the packing box 4. The result is enumerated in Table 1.

Comparative Example 1

The tape, as used for the packing, was identical with that of Example 1. For packing this fastener tape, the bent delivery pipe 3 of Example 1 was replaced by a straight pipe 3 guide, which was not rotated but merely guided the fastener tape to drop by its own weight into a packing box like that of Example 1.

As to ten packing boxes thus obtained, the trailing end of the fastener tape was subjected to the let-off test through the guide rolls by the pinch rollers. As a result, three entanglements of the fastener tape occurred, and the fastener tape in the packing box had to be disentangled by interrupting the let-off.

Separately of this, moreover, the number of winds of the fastener tape in one direction was confirmed by packing it in the naturally dropping state and by switching the turning direction of the fastener tape in the packing box. The result is also enumerated in Table 1.

TABLE 1

| | No. at Wind Unit till Reverse | |
|---|---|---|
| No. of Winds in Direction till Reverse | Example 1 | Comparative example 1 |
| <1 | 2 | 204 |
| 1 | 1 | 243 |
| 2 | 0 | 99 |
| 3 | 0 | 58 |
| 4 | 3 | 22 |
| 5 | 249 | 8 |
| 6 | 2 | 15 |
| 7 | 0 | 4 |
| 8 | 0 | 7 |
| 9 | 0 | 3 |
| 10 | 0 | 3 |
| 11 | 0 | 1 |
| 12 | 0 | 1 |
| 13 | 0 | 1 |

According to the method of the invention, the tape can be packed in such a preferable mode that it can be let off with neither twist nor entanglement from its packing box.

What is claimed is:

1. A tape packing method for boxing and packing a tape, comprising the steps of:

applying a turning force around a center portion of a packing box to the tape being dropped into the packing box;

alternately reversing a direction of the turning force to be applied at a predetermined number of turns the tape takes around the center portion; and at least one of continuously and intermittently changing a turning radius simultaneously with the application of the turning force and the alternate reversal of the direction of the turning force.

2. A tape packing method for boxing and packing a tape, comprising the steps of:

applying a turning force around a center portion of a packing box to the tape being dropped into the packing box;

alternately reversing a direction of the turning force to be applied at a predetermined number of turns the tape takes around the center portion; and at least one of continuously and intermittently changing a position of a center around which the tape turns simultaneously with the application of the turning force and the alternate reversal of the direction of the turning force.

3. A tape packing method for boxing and packing a tape, comprising the steps of:

applying a turning force around a center portion of a packing box to the tape being dropped into the packing box;

alternately reversing a direction of the turning force to be applied at a predetermined number of turns the tape takes around the center portion; and at least one of continuously and intermittently changing the predetermined number of turns simultaneously with the application of the turning force and the alternate reversal of the direction of the turning force.

4. A tape packing method according to any of claims 2 to 3, wherein the application of the turning force to the tape is carried out by a delivery pipe having a bent portion.

5. A tape packing method for boxing and packing a tape, comprising the steps of:

dropping the tape between a center and a side wall of a packing box;

turning the packing box around a center portion of the packing box;

alternately reversing a direction of the turning at a predetermined number of turns the tape takes around the center portion; and while packing the tape into the packing box, moving the packing box in a horizontal direction such that a position of a center around which the tape turns is changed.

6. A tape packing method according to any of claims 2–3 or 5, wherein the tape is a fastener tape or zipper tape made of a synthetic resin.

* * * * *